US009863272B2

(12) United States Patent
Shoyama

(10) Patent No.: US 9,863,272 B2
(45) Date of Patent: Jan. 9, 2018

(54) TURBOMACHINE

(71) Applicant: Panasonic Intellectual Property Management Co., Ltd., Osaka (JP)

(72) Inventor: Tadayoshi Shoyama, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 347 days.

(21) Appl. No.: 14/680,044

(22) Filed: Apr. 6, 2015

(65) Prior Publication Data

US 2015/0300193 A1 Oct. 22, 2015

(30) Foreign Application Priority Data

Apr. 18, 2014 (JP) ..... 2014-086100

(51) Int. Cl.
*F01D 25/16* (2006.01)
*F01D 11/00* (2006.01)
(Continued)

(52) U.S. Cl.
CPC ..... *F01D 25/16* (2013.01); *F01D 5/12* (2013.01); *F01D 11/005* (2013.01); *F04D 17/122* (2013.01); *F04D 29/057* (2013.01)

(58) Field of Classification Search
CPC ..... F01D 11/005; F01D 5/12; F01D 25/16; F01D 25/162; F01D 25/18;
(Continued)

(56) References Cited

U.S. PATENT DOCUMENTS 2,660,366 A * 11/1953 Klein ..... F04D 27/0215 415/118
4,125,345 A * 11/1978 Yoshinaga ..... F04D 17/12 415/179
(Continued)

FOREIGN PATENT DOCUMENTS

CN 101709667 5/2010
FR 2869654 B 10/2007
(Continued)

OTHER PUBLICATIONS

The Extended European Search Report dated Oct. 8, 2015 for the related European Patent Application No. 15161986.3.
(Continued)

*Primary Examiner* — Dwayne J White
*Assistant Examiner* — Sang K Kim
(74) *Attorney, Agent, or Firm* — McDermott Will & Emery LLP

(57) ABSTRACT

A turbomachine of this disclosure includes a rotation shaft, a first impeller, a first bearing, and a second bearing. The first impeller is fixed to the rotation shaft and includes a low-pressure-side surface. The first bearing is adjacent to the low-pressure-side surface of the first impeller and supports the rotation shaft. The second bearing is disposed on an opposite side of the first impeller from the first bearing and supports the rotation shaft. The rotation shaft includes a first tapered portion gradually increasing in diameter toward the first impeller. The first bearing includes a first support surface supporting the first tapered portion.

15 Claims, 10 Drawing Sheets

(51) Int. Cl.
*F01D 5/12* (2006.01)
*F04D 17/12* (2006.01)
*F04D 29/057* (2006.01)

(58) Field of Classification Search
CPC .. F04D 13/0633; F04D 17/122; F04D 25/062; F04D 29/04; F04D 29/046; F04D 29/056; F04D 29/057; F16C 17/105; F16C 17/107; F16C 17/26; F16C 33/1075
See application file for complete search history.

(56) References Cited

U.S. PATENT DOCUMENTS

| | | | | |
|---|---|---|---|---|
| 5,449,235 | A | 9/1995 | Buckmann | |
| 2006/0083642 | A1 | 4/2006 | Cook | |
| 2015/0308459 | A1* | 10/2015 | Lardy | F04D 17/122 415/1 |
| 2016/0290354 | A1* | 10/2016 | Yagi | F04D 17/122 |
| 2016/0327056 | A1* | 11/2016 | Nakaniwa | F04D 27/0238 |

FOREIGN PATENT DOCUMENTS

| | | | |
|---|---|---|---|
| GB | 2301399 | A | 12/1996 |
| GB | 2463453 | | 3/2010 |
| JP | 58-196319 | | 11/1983 |
| JP | 62-013816 | | 1/1987 |
| JP | 6-173871 | | 6/1994 |
| JP | 8-074848 | | 3/1996 |
| JP | 9-014181 | | 1/1997 |

OTHER PUBLICATIONS

English Translation of Chinese Search Report dated Mar. 4, 2016 for the related Chinese Patent Application No. 201510141771.7.

* cited by examiner

FIG. 12 *Prior Art*
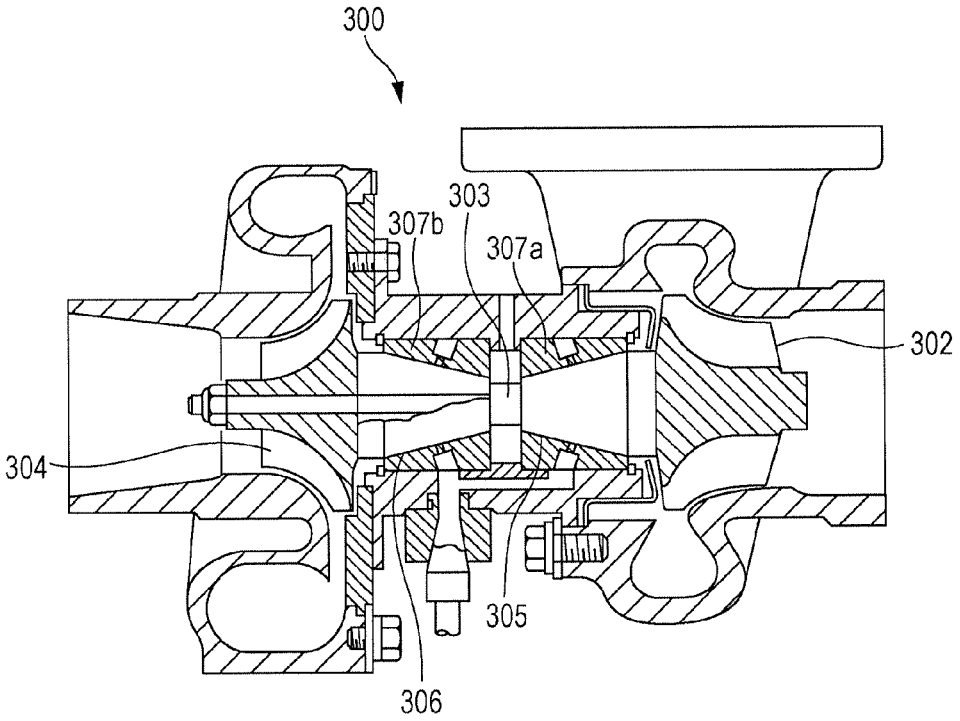

FIG. 13 *Prior Art*
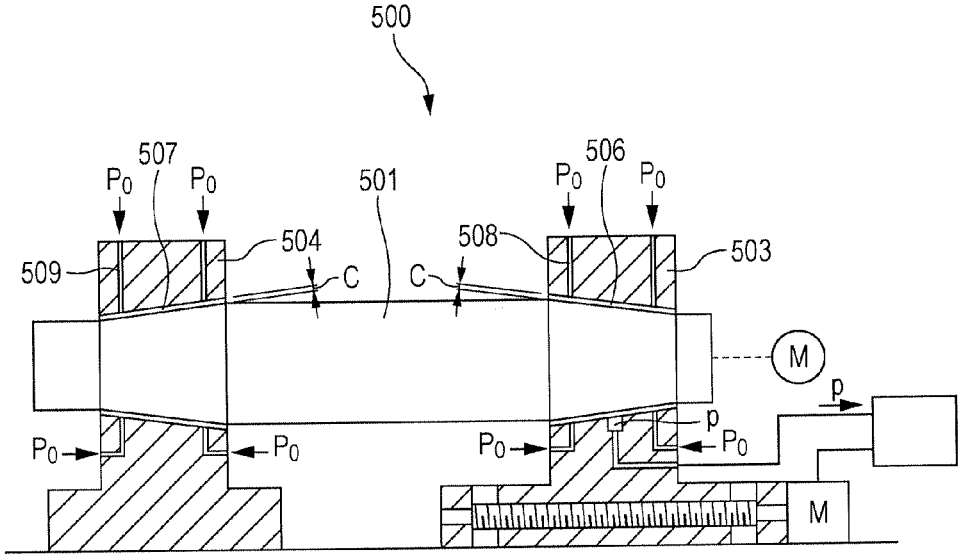

TURBOMACHINE

BACKGROUND

1. Technical Field

The present disclosure relates to a turbomachine.

2. Description of the Related Art

Conventionally known turbomachines include a thrust bearing, which supports an axial load (thrust load) resulting from differences in pressure between the surfaces of an impeller thereof, and a radial bearing, which supports a radial load. Some turbomachines include an angular bearing, which supports the thrust load and the radial load. As a bearing for a rotation shaft, a bearing having a tapered shape is known.

As illustrated in FIG. 12, Japanese Unexamined Patent Application Publication No. 62-13816 discloses a turbocharger 300 including a turbine 302, a rotation shaft 303, a compressor wheel 304, a collar 306, a bearing 307*a*, and another bearing 307*b*. The rotation shaft 303 includes a tapered portion 305 gradually increasing in diameter from a middle section of the rotation shaft 303 toward the turbine 302. The collar 306 has a tapered shape gradually increasing in diameter from the middle section of the rotation shaft 303 toward the compressor wheel 304. The collar 306 is fixed to the rotation shaft 303. The bearing 307*a* has a tapered shape corresponding to the shape of the tapered portion 305 and having a slightly larger diameter than the tapered portion 305. The bearing 307*b* has a tapered shape corresponding to the shape of the collar 306 and having a slightly larger diameter than the collar 306.

The bearing 307*a* and the bearing 307*b* are aerostatic bearings. Pressurized air is supplied around the tapered portion 305 and the collar 306. This lifts the tapered portion 305 and the collar 306 above the bearing 307*a* and the bearing 307*b*, respectively, and thus the rotation shaft 303 rotates without generating friction with the bearings 307*a*, 307*b*. The gas pressure acts on the tapered surface of the tapered portion 305 and the tapered surface of the collar 306 in a perpendicular direction. The gas pressure acts not only in the radial direction but also in the thrust direction. Thus, the turbocharger 300 does not require a thrust bearing.

As illustrated in FIG. 13, Japanese Unexamined Patent Application Publication No. 58-196319 discloses an air bearing apparatus 500 including a rotation shaft 501, a bearing 503, another bearing 504, an air bearing 506, another air bearing 507, a flow passage 508, and another flow passage 509. The air bearing 506 is disposed between the rotation shaft 501 and the bearing 503. The air bearing 507 is disposed between the rotation shaft 501 and the bearing 504. The bearings 503 and 504 include the flow passages 508 and 509, respectively. Pressurized air is supplied to the air bearings 506 and 507 through the flow passages 508 and 509, respectively. The air bearings 506 and 507 each have a tapered shape and are disposed such that a larger-diameter portion of the air bearing 506 is placed opposite to a larger-diameter portion of the air bearing 507. Japanese Unexamined Patent Application Publication No. 58-196319 does not disclose the positional relationship between the air bearing apparatus 500 and an impeller to be attached to the rotation shaft 501.

SUMMARY

One non-limiting and exemplary embodiment provides a turbomachine having good vibration characteristics, since the turbocharger 300 described in Japanese Unexamined Patent Application Publication No. 62-13816 leaves room for improvement in the vibration characteristics of the turbocharger 300 during rotation of the rotation shaft 303.

In one general aspect, the techniques disclosed here feature a turbomachine for a refrigeration cycle apparatus using a refrigerant as a working fluid having a negative saturated vapor pressure at a normal temperature. The turbomachine includes a rotation shaft, a first impeller fixed to the rotation shaft and including a low-pressure-side surface subjected to a relatively low pressure by the working fluid during rotation of the rotation shaft, and including a high-pressure-side surface subjected to a relatively low pressure by the working fluid during rotation of the rotation shaft, a first bearing disposed on the low-pressure-side surface of the first impeller and supporting the rotation shaft, and a second bearing disposed on the high-pressure-side surface of the first impeller from the first bearing and supporting the rotation shaft. The rotation shaft includes a first tapered portion at least within an area supported by the first bearing. The first tapered portion gradually increases in diameter toward the low-pressure-side surface of the first impeller. The first bearing includes a first support surface gradually increasing in diameter toward the low-pressure-side surface of the first impeller. The first support surface supports the first tapered portion. The first bearing, the first impeller, and the second bearing are disposed in this order in a longitudinal direction of the rotation shaft.

The above-described turbomachine has good vibration characteristics.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

BRIEF DESCRIPTION OF THE DRAWINGS

FIG. 12 is a cross-sectional view illustrating a conventional turbocharger; and FIG. 13 is a cross-sectional view of a conventional air bearing apparatus.

DETAILED DESCRIPTION

Figure 1:
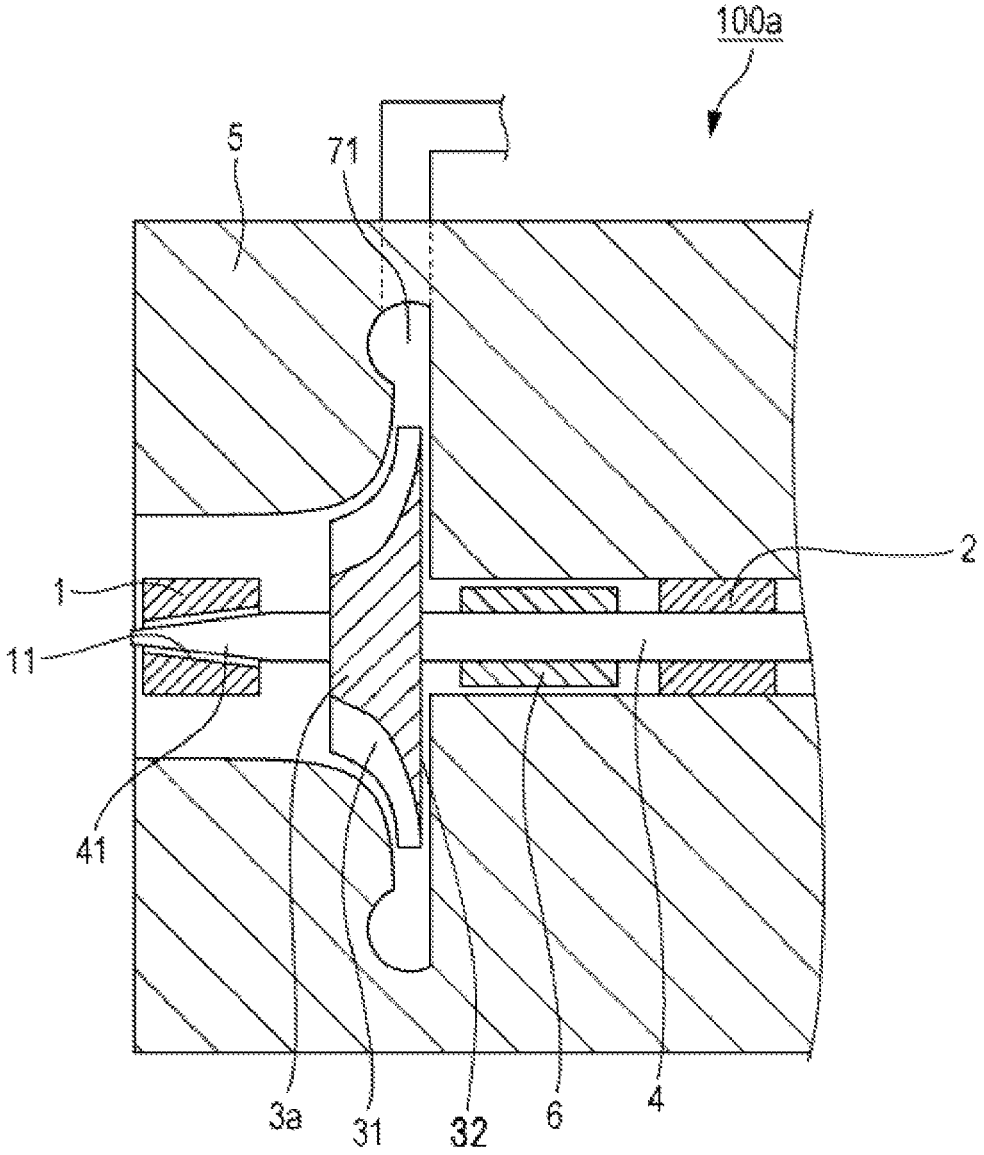
FIG. 1 is a cross-sectional view of a turbomachine according to one example of a first embodiment.

Findings Forming Basis of the Present Disclosure

The inventors of the present disclosure studied turbomachines that use a working fluid having a negative (lower than the atmospheric pressure in terms of absolute pressure) saturated vapor pressure at a normal temperature (20° C.±15° C. defined in JIS Z8703 (Japanese Industrial Standard)) and discharges the working fluid having a negative pressure. As a result of the study, the following findings were obtained.

In a refrigeration cycle apparatus using a refrigerant as a working fluid having a negative saturated vapor pressure at a normal temperature, the turbomachine thereof is required to have a high pressure ratio compared to that of a refrigeration cycle apparatus that uses a refrigerant as a working fluid having a positive saturated vapor pressure at a normal temperature. To satisfy the requirement, the rotation body of the turbomachine needs to have an extremely high rotational speed, which is likely to cause abnormal vibration in the turbomachine as a result of resonance. The inventors of the present disclosure conducted a comprehensive study and found that the abnormal vibration as a result of resonance is reduced by making the natural frequency of the rotation shaft higher than a rated rotational speed. This is achieved by concentrating the axial mass distribution of the rotation body at a position close to the center of gravity of the rotation body to increase the bending natural frequency of the rotation body. Based on the above findings, the inventors developed the techniques including the following aspects.

A turbomachine according to a first aspect of this disclosure is a turbomachine for a refrigeration cycle apparatus using a refrigerant as a working fluid having a negative saturated vapor pressure at a normal temperature. The turbomachine includes a rotation shaft, a first impeller fixed to the rotation shaft and including a low-pressure-side surface subjected to a relatively low pressure by the working fluid during rotation of the rotation shaft, and including a high-pressure-side surface subjected to a relatively low pressure by the working fluid during rotation of the rotation shaft, a first bearing disposed on the low-pressure-side surface of the first impeller and supporting the rotation shaft, and a second bearing disposed on the high-pressure-side surface of the first impeller from the first bearing and supporting the rotation shaft. The rotation shaft includes a first tapered portion at least within an area supported by the first bearing. The first tapered portion gradually increases in diameter toward the low-pressure-side surface of the first impeller. The first bearing includes a first support surface gradually increasing in diameter toward the low-pressure-side surface of the first impeller. The first support surface supports the first tapered portion. The first bearing, the first impeller, and the second bearing are disposed in this order in a longitudinal direction of the rotation shaft.

According to the first aspect, the first impeller having a relatively large mass is disposed between the first bearing and the second bearing. With this configuration, the mass distribution of the rotation body including the rotation shaft is unlikely to be concentrated at a position away from the center of the gravity. Thus, the natural frequency of the rotation body including the rotation shaft is relatively high, and high-speed rotation of the rotation shaft is unlikely to cause resonance and consequently abnormal vibration. As a result, the turbomachine according to the first aspect has good vibration characteristics.

According to the first aspect, the first bearing includes the first support surface supporting the first tapered portion, and the first bearing is disposed adjacent to the low-pressure-side surface of the first impeller. The first tapered portion gradually increases in diameter toward the first impeller. With this configuration, a middle section of the rotation shaft has a relatively large cross-sectional area. Thus, the bending natural frequency of the rotation body including the rotation shaft is relatively high, and high-speed rotation of the rotation shaft is unlikely to cause resonance and consequently abnormal vibration. In addition, according to the first aspect, since the first bearing is adjacent to the low-pressure-side surface of the first impeller, the thrust load applied in the direction from the first impeller to the first bearing is supported by the first bearing.

According to the first aspect, the refrigerant having a negative saturated vapor pressure at the normal temperature is used as the working fluid. As described above, if the refrigerant having a negative saturated vapor pressure at the normal temperature is used as the working fluid, the impeller of the turbomachine is required to have a high rotational speed, which is likely to cause abnormal vibration in the turbomachine as a result of resonance. However, in the turbomachine according to the first aspect, the abnormal vibration as a result of resonance is reduced even though the refrigerant having negative saturated vapor pressure at the normal temperature is used as the working fluid.

In addition, when the refrigerant having a negative saturated vapor pressure at the normal temperature is used as the working fluid, the thrust load to be generated in a turbomachine is very low, even if the turbomachine is a turbocompressor having a high pressure ratio (e.g., pressure ratio of 2 or more), for example. Therefore, according to the first aspect, the thrust load generated by the rotation is supported by the first bearing (e.g., tapered plain bearing) alone, which includes the first support surface for supporting the first tapered portion. The turbomachine according to the first aspect has a simple configuration compared to a turbomachine that includes a thrust bearing and a radial bearing as separate members.

The turbomachine according to the first aspect of this disclosure is superior to the turbocharger disclosed in Japanese Unexamined Patent Application Publication No. 62-13816 in terms of the following points. In the turbocharger 500 disclosed in Japanese Unexamined Patent Application Publication No. 62-13816, the rotation shaft 303 has the smallest diameter at the middle section thereof and the compressor wheel 304 is fixed to the front end of the rotation shaft 303. In this configuration, the bending natural frequency of the rotation body including the rotation shaft 303 and the compressor wheel 304 is low, and abnormal vibration may be generated at the rotation shaft 303 by the resonance that develops during high-speed rotation of the rotation shaft 303. However, as described above, in the turbomachine disclosed in this disclosure, the first tapered portion increases in diameter toward the first impeller. With this configuration, the middle section of the rotation shaft has a relatively large cross-sectional area. Thus, the bending natural frequency of the rotation body including the rotation shaft is relatively high, and high-speed rotation of the rotation shaft is unlikely to cause resonance and consequently abnormal vibration. In addition, in the turbocharger 500 disclosed in Japanese Unexamined Patent Application Publication No. 62-13816, the rotation shaft 303 or the casing should be formed of at least two pieces because of its structure. This may cause problems such as insufficient rigidity and vibration generation. The turbomachine according to the first aspect is free from such problems.

According to a second aspect of this disclosure, the turbomachine of the first aspect may further include a second impeller fixed to the rotation shaft, for example. The first bearing, the first impeller, the second impeller, and the second bearing may be disposed in this order in the longitudinal direction of the rotation shaft. According to the second aspect, when the turbomachine is a turbocompressor, for example, compression efficiency is improved by the two-stage compression, and a high compression ratio is achieved.

According to a third aspect of this disclosure, in the turbomachine of the second aspect, a surface of the second impeller subjected to a relatively low pressure by the working fluid during rotation of the rotation shaft (a low-pressure-side surface of the second impeller) may be closer to the second bearing than a surface of the second impeller subjected to a relatively high pressure by the working fluid during rotation of the rotation shaft (a high-pressure-side surface of the second impeller). According to the third aspect, the direction of the thrust load generated by the first impeller and the direction of the thrust load generated by the second impeller are opposite, and thus the thrust loads cancel each other out. With this configuration, when the turbomachine is a turbocompressor, for example, the range of the pressure ratio where the turbomachine is operational is broadened.

According to a fourth aspect of this disclosure, in the turbomachine of the second aspect, a surface of the second impeller subjected to a relatively high pressure by the working fluid during rotation of the rotation shaft (a high-pressure-side surface of the second impeller) may be closer to the second bearing than a surface of the second impeller subjected to a relatively low pressure by the working fluid during rotation of the rotation shaft (a low-pressure-side surface of the second impeller). According to the fourth aspect, the flow passage for the working fluid between the first impeller and the second impeller is shortened. As a result, the size of the turbomachine can be reduced.

According to a fifth aspect of this disclosure, in the turbomachine of any one of the first aspect to the fourth aspect, an inclination angle of the first support surface with respect to a center axial line of a tapered hole defined by the first support surface may be larger than an inclination angle of the first tapered portion with respect to a center axial line of the rotation shaft. According to the fifth aspect, in the axial direction of the rotation shaft, variation in the pressure applied to the lubricant between the first support surface and the first tapered portion is reduced. As a result, spatial variation in the bearing load is reduced and the bearing load capacity is increased.

According to a sixth aspect of this disclosure, in the turbomachine of any one of the first aspect to the fifth aspect, the first bearing may include a first supply hole through which a lubricant is supplied to the first support surface. According to the sixth aspect, the lubricant is supplied to the first support surface, and thus galling due to an insufficient amount e of the lubricant is reduced.

According to the seventh aspect of this disclosure, in the turbomachine of the sixth aspect, the first supply hole may be disposed closer to a smallest-diameter end of the first tapered portion than to a largest-diameter end of the first tapered portion. According to the seventh aspect, the hydrostatic effect due to the lubricant is preferentially applied to a smaller-diameter portion of the first tapered portion where a pressure of the lubricant is relatively low. As a result, the entire bearing load capacity of the first bearing is increased.

According to an eighth aspect of this disclosure, in the turbomachine of one of the sixth aspect and the seventh aspect, the first bearing may include a first porous member constituting at least a part of the first support surface. According to the eighth aspect, spatial variation in temperature or pressure is reduced in the first bearing.

According to a ninth aspect of this disclosure, in the turbomachine of any one of the first aspect to the eighth aspect, the rotation shaft may extend in the gravity direction, and the low-pressure-side surface of the first impeller may be disposed in the gravity direction above a surface of the first impeller that is subjected to a relatively large pressure by the working fluid during rotation of the rotation shaft. According to the ninth aspect, the thrust load generated by the rotation of the rotating shaft is cancelled out by gravity acting on the rotation body, which includes the rotation shaft and the first impeller. With this configuration, when the turbomachine is a turbocompressor, for example, the range of the pressure ratio where the turbomachine is operational is broadened.

According to a tenth aspect of this disclosure, in the turbomachine of any one of the first aspect to the ninth aspect, the rotation shaft may include a second tapered portion at a position corresponding to the second bearing. The second tapered portion gradually increases in diameter toward the first impeller. The second bearing may include a second support surface gradually increasing in diameter toward the first impeller. The second bearing supports the second tapered portion. According to the tenth aspect, the thrust load acting in the direction opposite to the direction from the first impeller toward the first bearing is supported by the second bearing.

According to an eleventh aspect of this disclosure, in the turbomachine of the tenth aspect, an inclination angle of the second support surface with respect to a center axial line of a tapered hole defined by the second support surface may be larger than an inclination angle of the second tapered portion with respect to a center axial line of the rotation shaft. According to the eleventh aspect, in the axial direction of the rotation shaft, variation in pressure applied to the lubricant contained between the second support surface and the second tapered surface is reduced. As a result, spatial variation in the bearing load is reduced and the bearing load capacity is increased.

According to a twelfth aspect of this disclosure, in the turbomachine of one of the tenth aspect and the eleventh aspect, the second bearing may include a second supply hole through which a lubricant is supplied to the second support surface. According to the twelfth aspect, the lubricant is supplied to the second support surface, and thus galling due to an insufficient amount of the lubricant is reduced.

According to a thirteenth aspect of this disclosure, in the turbomachine of the twelfth aspect, the second supply hole may be disposed closer to a smallest-diameter end of the second tapered portion than to a largest-diameter end of the second tapered portion. According to the thirteenth aspect, the hydrostatic effect due to the lubricant is preferentially applied to a smaller-diameter portion of the second tapered portion where a pressure of the lubricant is relatively low. As a result, the entire bearing load capacity of the second bearing is increased.

According to a fourteenth aspect of this disclosure, in the turbomachine of one of the twelfth aspect and the thirteenth aspect, the second bearing may include a second porous member constituting at least a part of the second support surface. According to the fourteenth aspect, spatial variation in temperature or pressure of the lubricant is reduced in the second bearing.

A turbomachine according to a fifteenth aspect of this disclosure is a turbomachine for a refrigeration cycle apparatus using a refrigerant as a working fluid having a negative saturated vapor pressure at a normal temperature. The turbomachine includes a rotation shaft, a first impeller including a low-pressure-side surface subjected to a relatively low pressure by the working fluid during rotation of the rotation shaft and a high-pressure-side surface opposite the low-pressure-side surface, the first impeller generating a force by creating a difference in pressure between the low-pressure-side surface and the high-pressure-side surface from the high-pressure-side surface toward the low-pressure-side surface, and a first bearing adjacent to the low-pressure-side surface of the first impeller and supporting the rotation shaft. A rotation body including the first impeller and the rotation shaft has a center of gravity at a position adjacent to the high-pressure-side surface of the first impeller. The rotation shaft includes a first tapered portion adjacent to the low-pressure-side surface of the first impeller. The first tapered portion gradually increases in diameter toward the low-pressure-side surface of the first impeller. The first bearing includes a first support surface gradually increasing in diameter toward the low-pressure-side surface of the first impeller and supporting the first tapered portion.

Hereinafter, embodiments of this disclosure will be described with reference to the drawings. The following description is merely an example of this disclosure, and this disclosure is not limited to the description.

First Embodiment

As illustrated in FIG. 1, a turbomachine 100*a* includes a rotation shaft 4, a first impeller 3*a*, a first bearing 1, and a second bearing 2. The turbomachine 100*a* is a turbocompressor, for example. The first impeller 3*a* is fixed to the rotation shaft 4. The first impeller 3*a* includes a low-pressure-side surface 31 and a high-pressure-side surface 32. The low-pressure-side surface 31 is one of a surface of the first impeller 3*a* in the axial direction which is subjected to a relatively low pressure by a working fluid during rotation of the rotation shaft 4. The high-pressure-side surface 32 is one of a surface of the first impeller 3*a* in the axial direction which is subjected to a relatively high pressure by a working fluid during rotation of the rotation shaft 4. The first bearing 1 is adjacent to the low-pressure-side surface 31 of the first impeller 3*a*. The first bearing 1 is formed to support the rotation shaft 4. The first bearing 1 supports a front end of the rotation shaft 4 in an area between an inlet of the working fluid and the first impeller 3*a*. The second bearing 2 is disposed such that the first impeller 3*a* is disposed between the second bearing 2 and the first bearing 1. The second bearing 2 is formed to support the rotation shaft 4. The second bearing 2 is disposed on an opposite side of the first impeller 3*a* from the low-pressure-side surface 31. The rotation shaft 4 includes a first tapered portion 41 gradually increasing in diameter toward the first impeller 3*a*. The first tapered portion 41 is adjacent to the low-pressure-side surface 31 of the first impeller 3*a*. The first bearing 1 includes a first support surface 11 supporting the first tapered portion 41.

The turbomachine 100*a* further includes a casing 5 and a motor 6. The first impeller 3*a* and the motor 6 are connected through the rotation shaft 4. The second bearing 2 is disposed farther from the first impeller 3*a* than the motor 6. The casing 5 defines an ejection passage 71 at a position close to an outer periphery of the first impeller 3*a*. Driving of the motor 6 rotates the first impeller 3*a* with the rotation shaft 4 at a high speed. The rotation allows the working fluid to flow from the front side of the first impeller 3*a* (left side of the first impeller 3*a* in FIG. 1) to the first impeller 3*a*. The working fluid is accelerated and pressurized by the rotating first impeller 3*a* and then ejected from the turbomachine 100*a* through the ejection passage 71. At this time, the left surface of the first impeller 3*a* in FIG. 1 is subjected to an inlet pressure of the working fluid and the right surface of the first impeller 3*a* is subjected to the pressure substantially equal to a discharge pressure. In other words, the low-pressure-side surface 31 is subjected to a relatively low pressure by the working fluid during rotation of the rotation shaft 4. A pressure difference exists between two surfaces of the first impeller 3*a* in the axial direction, and the pressure difference generates a thrust load acting on a rotation body including the rotation shaft 4 and the first impeller 3*a* in the leftward direction in FIG. 1. The first bearing 1 is a plain bearing, for example, and a lubricant is applied between the first support surface 11 and the first tapered portion 41. The first support surface 11 defines a tapered hole which has a diameter slightly larger than that of the first tapered portion 41. In other words, the tapered hole gradually increasing in diameter toward the first impeller 3*a* is defined by the first support surface 11. The tapered hole supports the generated thrust load.

In the turbomachine 100*a*, the first impeller 3*a* having a relatively large mass is disposed between the first bearing 1 and the second bearing 2. With this configuration, a mass distribution of the rotation body, which includes the rotation shaft 4 and the first impeller 3*a*, is unlikely to be concentrated at a position away from the center of the gravity, and thus the bending natural frequency of the rotation body is unlikely to be reduced. This enables the bending natural frequency of the rotation body, which includes the rotation shaft 4 and the first impeller 3*a*, to be sufficiently higher than the rotational speed of the rotation body. With this configuration, the rotational speed of the rotation body is not close to the bending natural frequency of the rotation body, and thus high-speed rotation of the rotation shaft 4 is unlikely to cause resonance and consequently abnormal vibration. As a result, the turbomachine 100*a* has good vibration characteristics.

The bending natural frequency of the rotation body increases with an increase in the cross-sectional area of the rotation body. Particularly, the bending natural frequency of the rotation body is largely affected by the cross-sectional area of the middle section of the rotation shaft in a first bending vibration mode. The first bearing 1 includes the first support surface 11 supporting the first tapered portion 41, and the first bearing 1 is adjacent to the low-pressure-side surface 31 of the first impeller 3*a*. The first tapered portion 41 gradually increases in diameter toward the first impeller 3*a*. The rotation shaft 4 has a relatively large cross-sectional area at the middle section thereof. With this configuration, high-speed rotation of the rotation shaft 4 is unlikely to cause resonance and consequently abnormal vibration. As a result, the turbomachine 100*a* has good vibration characteristics.

Figure 2:
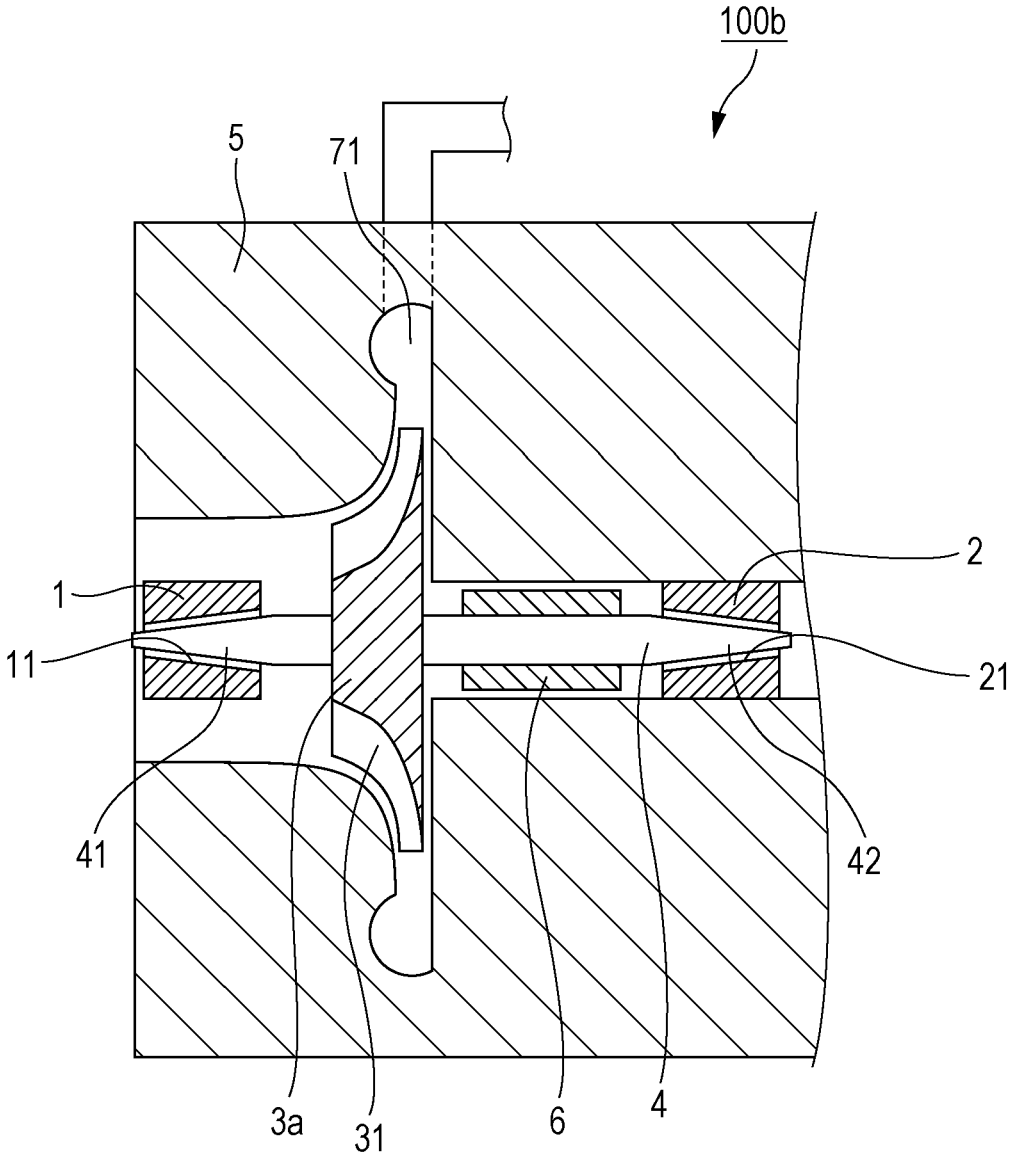
FIG. 2 is a cross-sectional view of a turbomachine according to another example of the first embodiment.

The rotation shaft 4 and the second bearing 2 may be configured as illustrated in FIG. 2. A turbomachine 100*b* has the same configuration as the turbomachine 100*a* except that the rotation shaft 4 and the second bearing 2 have the configuration as illustrated in FIG. 2. In the turbomachine 100*b*, the rotation shaft 4 includes a second tapered portion 42. The second tapered portion 42 gradually increases in diameter toward the first impeller 3*a*. The second bearing 2 includes a second support surface 21 supporting the second tapered surface 21. The second bearing 2 is a plain bearing, for example. The second support surface 21 defines a tapered hole having a diameter slightly larger than that of the second tapered portion 42. A lubricant is applied between the second support surface 21 and the second tapered portion 42.

During high-speed rotation of the rotation body, which includes the rotation shaft 4 and the first impeller 3*a*, a vibration load may be generated by an imbalance of mass properties of the rotation body or by an asymmetric hydrodynamic force of the working fluid. A large vibration load in the axial direction may allow the thrust load of the rotation body, which includes the rotation shaft 4 and the first impeller 3*a*, to act in the direction opposite to the direction from the first impeller 3*a* toward the first bearing 1. Such a thrust load is supported by the second bearing 2.

In the turbomachine 100*b*, the second bearing 2 is disposed such that the center of the rotation shaft 4 in the axial direction is disposed between the first bearing 1 and the second bearing 2. With this configuration, the cross-sectional area of the middle section of the rotation shaft 4 is not reduced. The rotation shaft 4 may be connected to a different rotation shaft by a universal joint, for example. However, in such a case, the bending vibration frequency of the rotation body, which includes the rotation shaft 4, is hardly affected by the different rotation shaft. Therefore, the different rotating shaft connected to the rotation shaft 4 is ignored when the center of the rotation shaft 4 in the axial direction is determined.

Second Embodiment

Next, a turbomachine 100*c* and a turbomachine 100*d* according to a second embodiment will be described. The turbomachine 100*c* and the turbomachine 100*d* according to the second embodiment have the same configuration as the turbomachine 100*a* unless otherwise specified. Components of the turbomachine 100*c* and components of the turbomachine 100*d* same as or similar to those of the turbomachine 100*a* are assigned the same reference numerals as the turbomachine 100*a* and will not be described in detail. The description about the first embodiment may also be applied to this embodiment unless a contradiction is recognized.

The turbomachine 100*c* further includes a second impeller 3*b*. The second impeller 3*b* is fixed to the rotation shaft 4. The first impeller 3*a* and the second impeller 3*b* are disposed between the first bearing 1 and the second bearing 2. Since the second bearing 2 of the turbomachine 100*c* has the same configuration as the second bearing 2 of the turbomachine 100*b*, the rotation shaft 4 includes the second tapered portion 42. The second impeller 3*b* includes a low-pressure-side surface 131 and a high-pressure-side surface 132. The low-pressure-side surface 131 is a surface of the second impeller 3*b* which is subjected to a relatively low pressure by the working fluid during rotation of the rotation shaft 4. The high-pressure-side surface 132 is disposed opposite the low-pressure-side surface 131. The casing 5 defines an ejection passage 73 at a position close to an outer periphery of the second impeller 3*b*. The turbomachine 100*c* further includes a connection passage 72 that allows communication between the ejection passage 71 and a space adjacent to the low-pressure-side surface 131 of the second impeller 3*b*. The turbomachine 100*c* is a turbocompressor, for example. The working fluid pressurized by the first impeller 3*a* is drawn to the second impeller 3*b* through the ejection passage 71 and the connection passage 72. The working fluid is accelerated and pressurized by the rotating second impeller 3*b*, and then ejected from the turbomachine 100*c* through the ejection passage 73. As described above, the working fluid is pressurized in two stages by the first impeller 3*a* and the second impeller 3*b*. Thus, compression efficiency is improved, and a high-pressure ratio is achieved.

Figure 3:
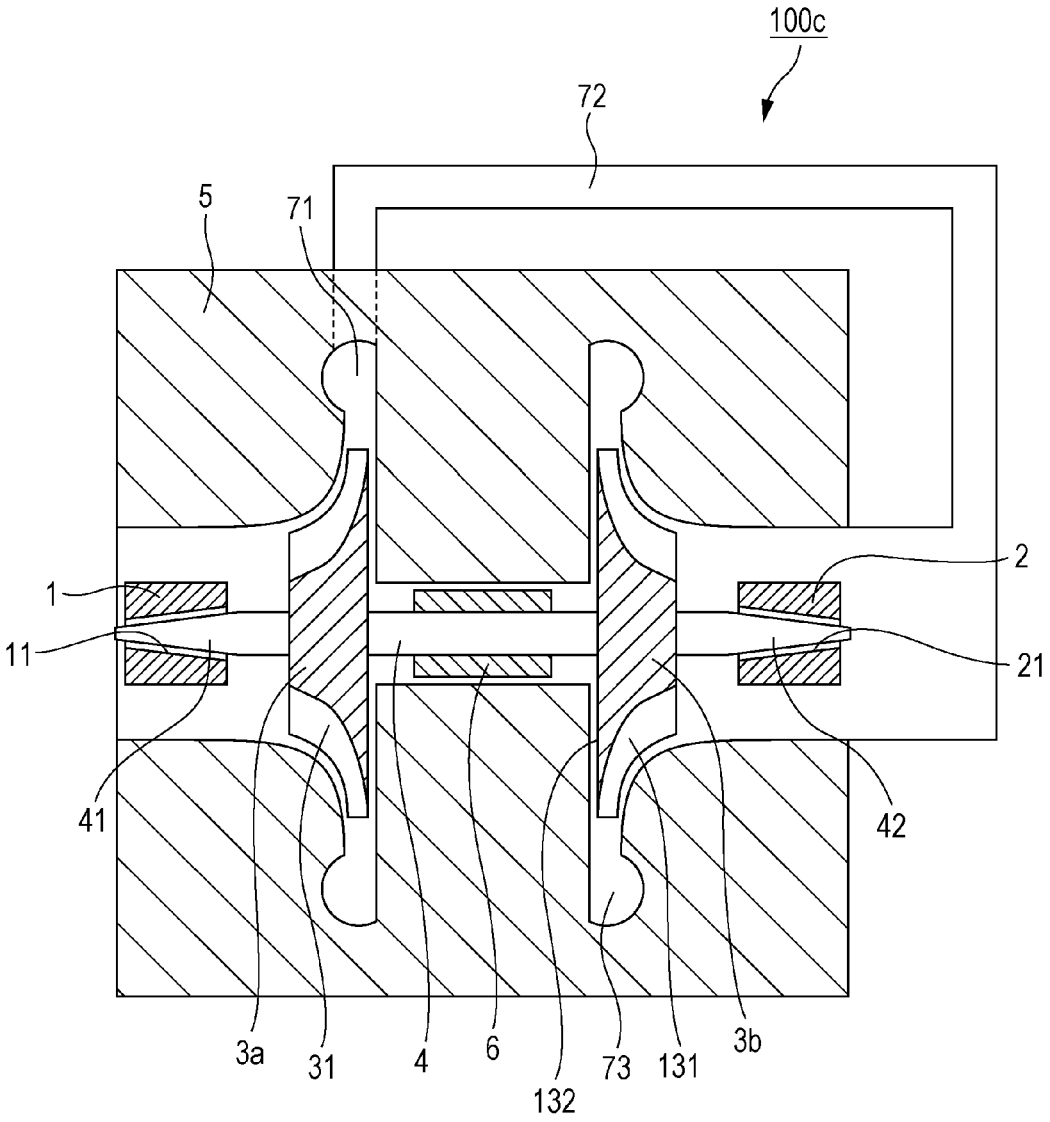
FIG. 3 is a cross-sectional view of a turbomachine according to one example of a second embodiment.

The second impeller 3*b* is fixed to the rotation shaft 4 such that the surface (high-pressure-side surface 132) which is opposite to the low-pressure-side surface 131 faces the first impeller 3*a*. During rotation of the second impeller 3*b*, the right surface of the second impeller 3*b* in FIG. 3 is subjected to the inlet pressure of the working fluid, and the left surface of the first impeller 3*a* is subjected to the pressure substantially equal to the discharge pressure of the working fluid. Thus, the thrust load acting in the rightward direction in FIG. 3 is generated by the rotation of the second impeller 3*b*. The direction of the thrust load generated by the rotation of the first impeller 3*a* and the direction of the thrust load generated by the rotation of the second impeller 3*b* are opposite, and thus the thrust loads cancel each other out. With this configuration, the range of the pressure ratio where the turbomachine 100*c* is operational is broad.

Figure 4:
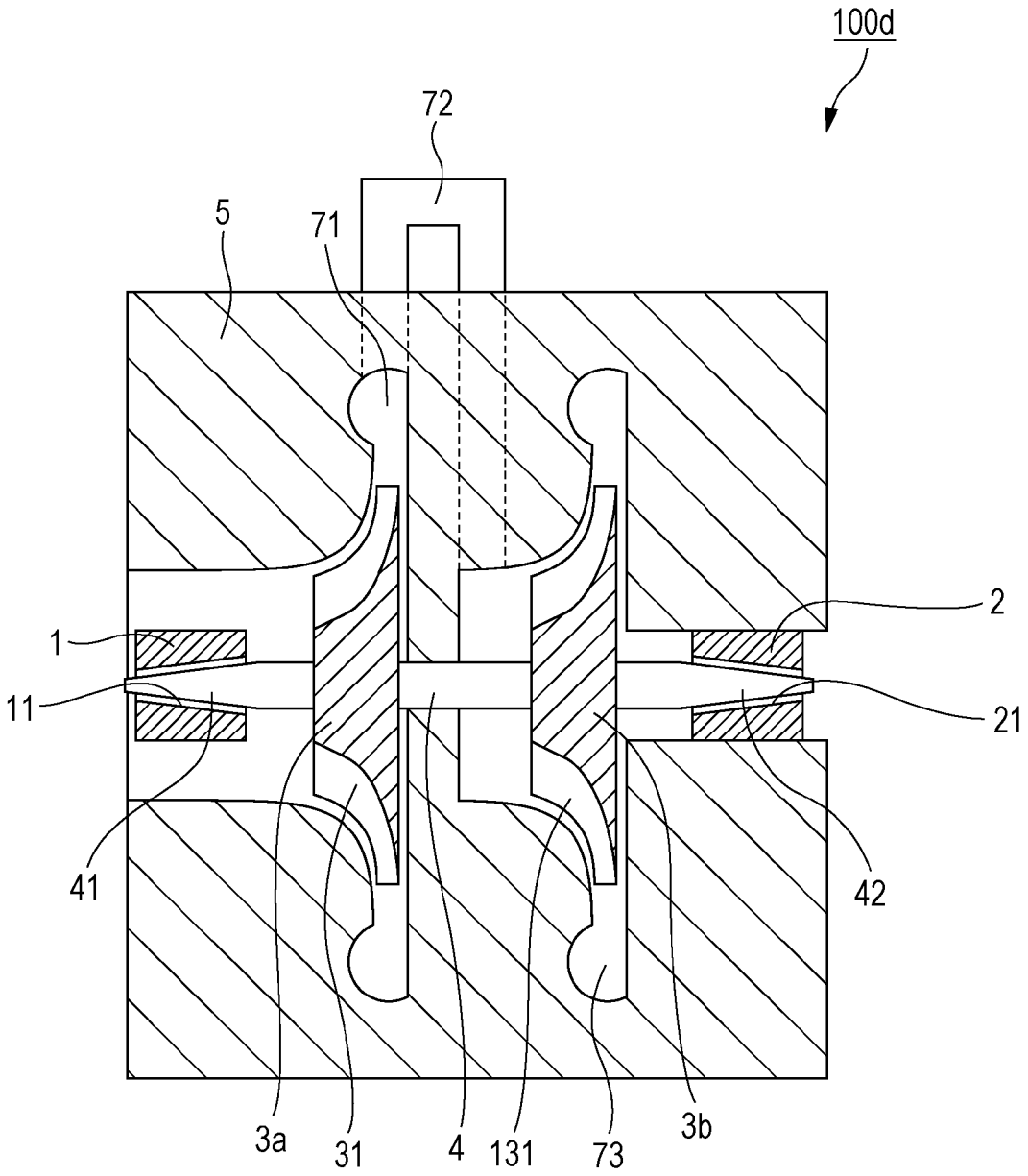
FIG. 4 is a cross-sectional view of a turbomachine according to another example of the second embodiment.

As a turbomachine 100*d* illustrated in FIG. 4, the second impeller 3*b* may be fixed to the rotation shaft 4 such that the low-pressure-side surface 131 faces the first impeller 3*a*. In such a case, a distance of the flow passage (connection passage 72) for the working fluid between the first impeller 3*a* and the second impeller 3*b* is shortened. As a result, the turbomachine 100*d* has a smaller size than the turbomachine 100*c*.

Modifications

The turbomachine 100*a* and the turbomachine 100*b* according to the first embodiment and the turbomachine 100*c* and the turbomachine 100*d* according to the second embodiment may be modified from various viewpoints. Hereinafter, modifications of the turbomachines 100*a* to 100*d* will be described. Components of the following modifications same as or similar to those of the turbomachines 100*a* to 100*d* are assigned the same reference numerals as the turbomachines 100*a* to 100*d* and will not be described in detail.

First Modification

Figure 5:
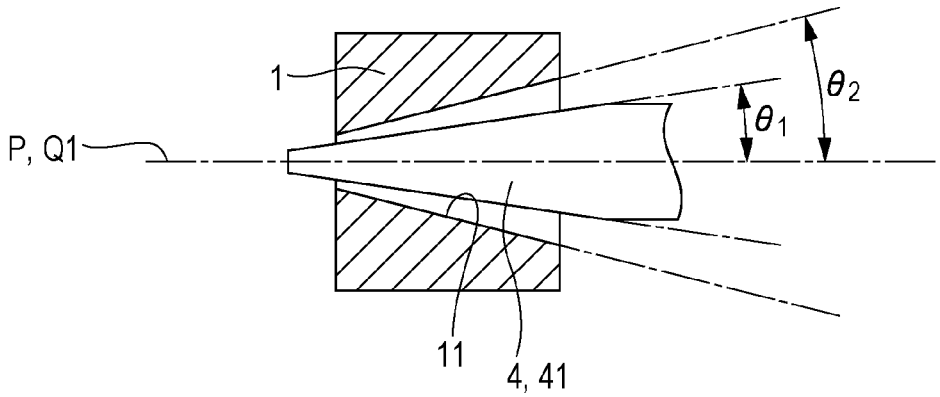
FIG. 5 is a cross-sectional view of a first tapered portion and a first bearing according to a first modification.
Figure 6:
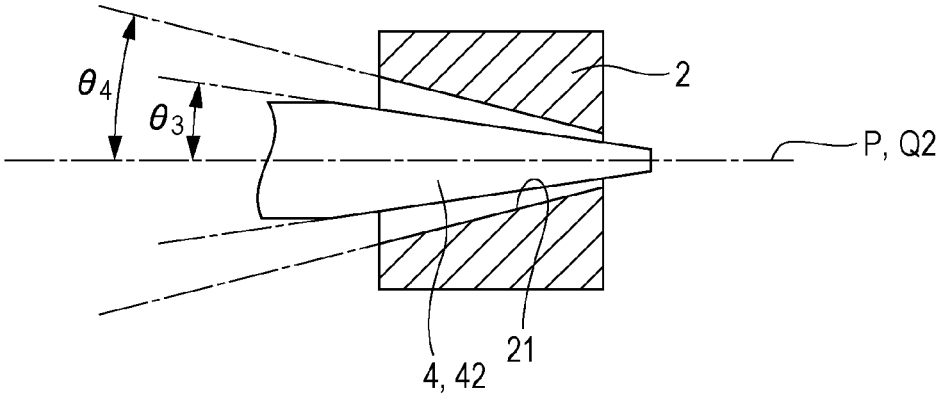
FIG. 6 is a cross-sectional view of a second tapered portion and a second bearing according to a first modification.

The support surface 11 of the first bearing 1 and the support surface 21 of the second bearing 2 may be configured as illustrated in FIG. 5 and FIG. 6, respectively. The first support surface 11 is configured such that an inclination angle $\theta_2$ of the first support surface 11 with respect to a center axial line Q1 of the tapered hole, which is defined by the first support surface 11, is larger than an inclination angle $\theta_1$ of the first tapered portion 41 with respect to a center axial line P of the rotation shaft 4. The second support surface 21 is configured such that an inclination angle $\theta_4$ of the second support surface 21 with respect to a center axial line Q2 of the tapered hole, which is defined by the second support surface 21, is larger than an inclination angle $\theta_3$ of the second tapered portion 42 with respect to the center axial line P of the rotation shaft 4. In the above cases, a ratio ($\theta_2/\theta_1$) between the inclination angle $\theta_2$ and the inclination angle $\theta_1$ is 1.0001 to 1.01, for example, and a ratio ($\theta_4/\theta_3$) between the inclination angle $\theta_4$ and the inclination angle $\theta_3$ is 1.0001 to 1.01, for example.

The lubrication condition between the bearing and the shaft, which are lubricated by the lubricant, may be evaluated by the following sommerfeld number:

$$\text{Sommerfeld number}=(\mu N/P)\times(R/c)^2,$$

where μ denotes a viscosity coefficient [Pa·s], N denotes a rotation speed of the shaft [$s^{-1}$], P denotes a load surface pressure (applied load/meridional cross-sectional area) [Pa], R denotes a radius [m] of the shaft, and c denotes a radial clearance [m] between the bearing and the shaft.

Figure 7:
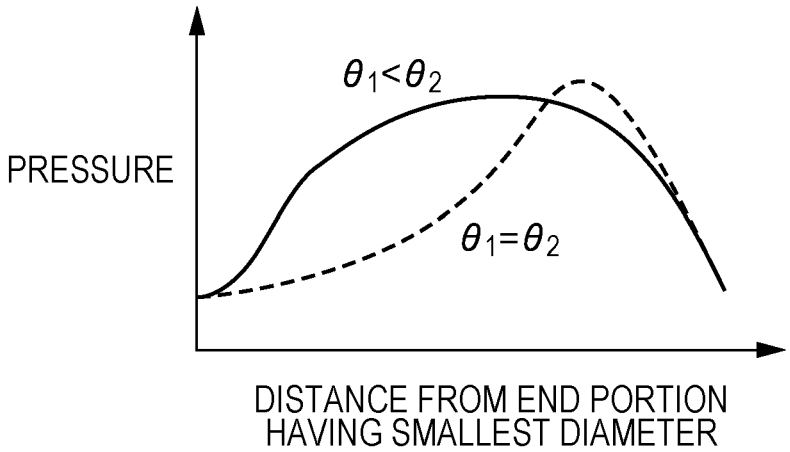
FIG. 7 is a graph showing an advantage of the first modification.

FIG. 7 indicates a relationship between the pressure of the lubricant, which is contained between the first support surface 11 and the first tapered surface 41, and the axial distance from the end portion of the first support surface 11 having the smallest diameter, where the diameter of the tapered hole defined by the first support surface 11 is the smallest. The smaller the sommerfeld number, the smaller the pressure applied to the lubricant. When the inclination angle $\theta_1$ is equal to the inclination angle $\theta_2$, as indicated by the broken line in FIG. 7, the pressure of the lubricant is larger at a portion of the first tapered portion 41 having a larger diameter since the radius of a large-diameter portion of the first tapered portion 41 is larger than that of a small-diameter portion of the first tapered portion 41. This results in concentration of the bearing load on the large-diameter portion of the first tapered portion 41. On the other hand, when the relationship between the inclination angle $\theta_1$ and the inclination angle $\theta_2$ is set as described above, the axial variations in the sommerfeld number in the first tapered portion 41 is reduced. This results in reduction in the axial variations in the pressure distribution of the lubricant in the first tapered portion 41 as indicated by the solid line in FIG. 7. Thus, the bearing load capacity increases. The same is applicable to the relationship between the inclination angle $\theta_3$ and the inclination angle $\theta_4$.

In a cross section of the first bearing 1 taken along the center axial line Q1, an imaginary intersection of two lines extending from ridgelines along the first support surface 11 is defined as an intersection point 1. In addition, in a cross section of the first tapered portion 41 taken along the center axial line P, an imaginary intersection of two lines extending from ridgelines of the first tapered portion 41 is defined as an intersection point 2. The first support surface 11 is preferably formed such that the intersection 1 meets the intersection 2 to reduce the axial variations in the sommerfeld number in the first tapered portion 41. The same is applicable to the relationship between the second support surface 21 and the second tapered portion 42.

Second Modification

Figure 8:
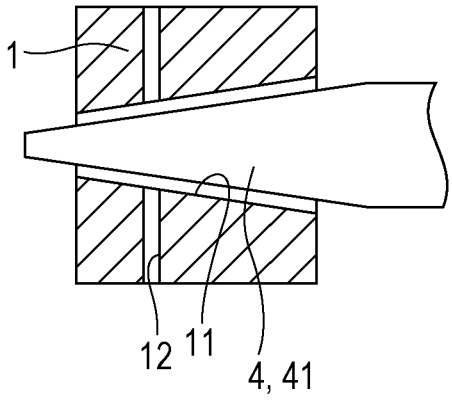
FIG. 8 is a cross-sectional view of a first tapered portion and a first bearing according to a second modification.

As illustrated in FIG. 8, the first bearing 1 may include a first supply hole 12 for supplying a lubricant to the first support surface 11. With this configuration, the lubricant is supplied to the first support surface 11, and thus galling due to an insufficient amount of the lubricant is reduced. In addition, the supply of the high-pressure lubricant through the first supply hole 12 provides the rotation body, which includes the rotation shaft 4, with bearing force by a hydrostatic effect. In addition to the bearing force by a hydrodynamic effect generated by the rotation of the rotation shaft 4, the bearing force by the hydrostatic effect is obtained. This enables the rotation shaft 4 to float even when the rotation of the rotation shaft 4 is suspended. As a result, wear of the bearing surface of the first bearing 1 and the rotation shaft 4 that may be caused during the suspension of the rotation of the rotation shaft 4 is remarkably reduced. Since the bearing force by the hydrostatic effect acts perpendicular onto the first support surface 11, not only a radial component of the bearing force, but also an axial component of the bearing force is obtained. Therefore, an axial bearing load capacity is increased.

As illustrated in FIG. 8, the first supply hole 12 is preferably disposed closer to the end of the first tapered portion 41 having the smallest diameter than to the other end of the first tapered portion 41 having the largest diameter. With this configuration, the hydrostatic effect due to the lubricant is preferentially-applied to a smaller-diameter portion of the first tapered portion 41 where a pressure of the lubricant is relatively low. Therefore, the entire bearing load capacity of the first bearing 1 is increased.

Figure 9:
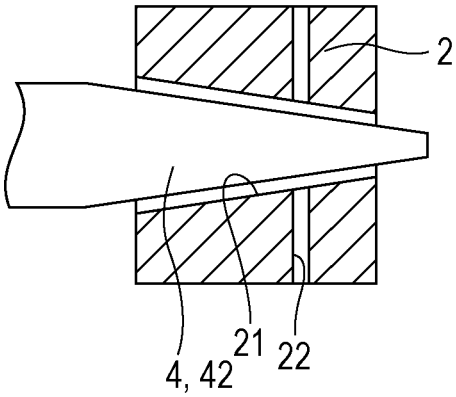
FIG. 9 is cross-sectional view of a second tapered portion and a second bearing according to a second modification.

As illustrated in FIG. 9, the second bearing 2 may include a second supply hole 22 for supplying a lubricant to the second support surface 21. The second supply hole 22 is preferably disposed closer to the end of the second tapered portion 42 having the smallest diameter than to the other end portion of the second tapered portion 42 having the largest diameter. With this configuration, the second bearing 2 also has the above-described advantage.

Third Modification

Figure 10:
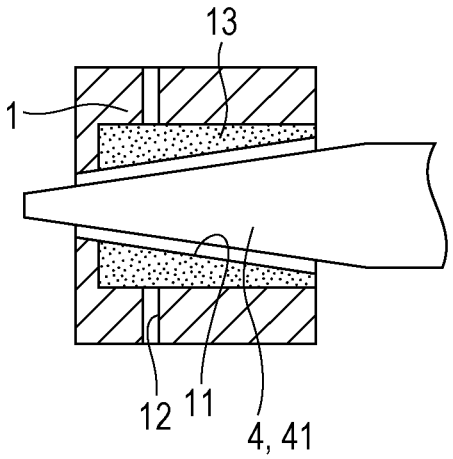
FIG. 10 is a cross-sectional view of a first tapered portion and a first bearing according to a third modification.
Figure 11:
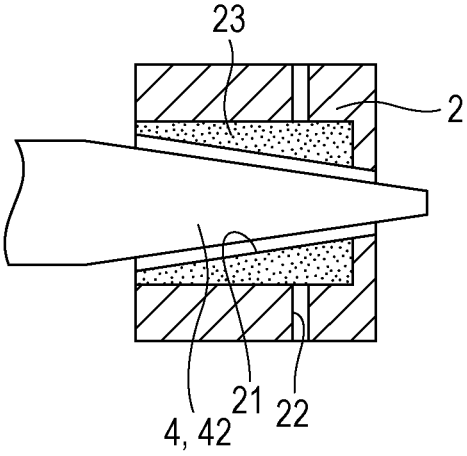
FIG. 11 is a cross-sectional view of a second tapered portion and a second bearing according to a third modification.

As illustrated in FIG. 10, in addition to the first supply hole 12, the first bearing 1 may include a first porous member 13 constituting at least a part of the first support surface 11. Furthermore, as illustrated in FIG. 11, in addition to the second supply hole 22, the second bearing 2 may include a second porous member 23 constituting at least a part of the second support surface 21. The first porous member 13 and the second porous member 23 are made of a porous material such as a sintered metal, a grown cast iron, and a synthetic resin. If the first bearing 1 includes one or a few first supply holes 12, a temperature or a pressure of the lubricant at a position close to the first supply hole 12 may differ from those of the lubricant at a position away from the first supply hole 12. This may result in unstable rotation of the rotation shaft 4. The same is applicable to the second bearing 2 including one or a few second supply holes 22. In the first bearing 1, spatial variation in temperature or pressure of the lubricant is reduced by the first porous member 13 constituting at least a part of the first support surface 11. Furthermore, in the second bearing 2, spatial variations in temperature or pressure of the lubricant are reduced by the second porous member 23 constituting at least a part of the second support surface 21.

Other Modifications

The rotation shaft 4 may extend in a horizontal direction or a vertical direction. In a case where the rotation shaft 4 extends in the vertical direction, the first impeller 3*a* is preferably fixed to the rotation shaft 4 such that the thrust load caused by the rotation of the rotation shaft 4 acts in the direction opposite to the gravity direction. In this configuration, the thrust load generated by the rotation of the rotation shaft 4 is cancelled out by the gravity acting on the rotation body, which includes the rotation shaft 4 and the first impeller 3*a*. Thus, the range of the pressure ratio where the turbomachine is operational is broadened.

The present disclosure is advantageously used in compressors for refrigeration cycle apparatuses applicable to centrifugal chiller air conditioners such as industrial air conditioners.

What is claimed is:

1. A turbomachine for a refrigeration cycle apparatus, the turbomachine comprising:

a rotation shaft;

a first impeller fixed to the rotation shaft, the first impeller including a first low-pressure-side surface and a first high-pressure-side surface;

a first bearing disposed on a first low-pressure-side of the first impeller, the first bearing supporting the rotation shaft; and a second bearing disposed on a first high-pressure-side of the first impeller from the first bearing, the second bearing supporting the rotation shaft, wherein:

the rotation shaft includes a first tapered portion at least within an area supported by the first bearing, the first tapered portion gradually increasing in diameter toward the first low-pressure-side surface of the first impeller, the first bearing includes a first support surface gradually increasing in diameter toward the first low-pressure-side surface of the first impeller, the first support surface supporting the first tapered portion, and the first bearing, the first impeller, and the second bearing are disposed in a longitudinal direction of the rotation shaft such that the first impeller is disposed between the first bearing and the second bearing.

2. The turbomachine according to claim 1, further comprising:

a second impeller fixed to the rotation shaft, wherein the first bearing, the first impeller, the second impeller, and the second bearing are disposed in the longitudinal direction of the rotation shaft such that the second impeller is disposed between the first impeller and the second bearing.

3. The turbomachine according to claim 2, wherein:

the second impeller includes a second low-pressure-side surface and a second high-pressure-side surface, and the second low-pressure-side surface of the second impeller is closer to the second bearing than the second high-pressure-side surface of the second impeller.

4. The turbomachine according to claim 2, wherein:

the second impeller includes a second low-pressure-side surface and a second high-pressure-side surface, and the second high-pressure-side surface of the second impeller is closer to the second bearing than the second low-pressure-side surface of the second impeller.

5. The turbomachine according to claim 1, wherein an inclination angle of the first support surface with respect to a center axial line of a tapered hole defined by the first support surface is larger than an inclination angle of the first tapered portion with respect to a center axial line of the rotation shaft.

6. The turbomachine according to claim 1, wherein the first bearing includes a first supply hole through which a lubricant is supplied to the first support surface.

7. The turbomachine according to claim 6, wherein the first supply hole is disposed closer to a smallest-diameter end of the first tapered portion than to a largest-diameter end of the first tapered portion.

8. The turbomachine according to claim 6, wherein the first bearing includes a first porous member constituting at least a part of the first support surface.

9. The turbomachine according to claim 1, wherein the rotation shaft extends in the gravity direction, and the first low-pressure-side of the first impeller is disposed in the gravity direction above the first high-pressure-side surface of the first impeller.

10. The turbomachine according to claim 1, wherein the rotation shaft includes a second tapered portion at a position corresponding to the second bearing, the second tapered portion gradually increasing in diameter toward the first impeller, and the second bearing includes a second support surface gradually increasing in diameter toward the first impeller, the second bearing supporting the second tapered portion.

11. The turbomachine according to claim 10, wherein an inclination angle of the second support surface with respect to a center axial line of a tapered hole defined by the second support surface is larger than an inclination angle of the second tapered portion with respect to a center axial line of the rotation shaft.

12. The turbomachine according to claim 10, wherein the second bearing includes a second supply hole through which a lubricant is supplied to the second support surface.

13. The turbomachine according to claim 12, wherein the second supply hole is disposed closer to a smallest-diameter end of the second tapered portion than to a largest-diameter end of the second tapered portion.

14. The turbomachine according to claim 12, wherein the second bearing includes a second porous member constituting at least a part of the second support surface.

15. The turbomachine according to claim 1, wherein the refrigeration cycle apparatus uses a refrigerant as a working fluid having a negative saturated vapor pressure at a normal temperature range which is 20° C.±15° C.

* * * * *